US011944116B1

(12) United States Patent
Tang et al.

(10) Patent No.: US 11,944,116 B1
(45) Date of Patent: Apr. 2, 2024

(54) DEVICE AND METHOD FOR REMOVING UNWANTED OBJECTS FROM CUT TOBACCO IN A CUT TOBACCO PRODUCTION LINE

(71) Applicant: CHINA TOBACCO YUNNAN INDUSTRIAL CO., LTD., Kunming (CN)

(72) Inventors: Jun Tang, Kunming (CN); Banghua He, Kunming (CN); Bin Yi, Kunming (CN); Bing Zhou, Kunming (CN); Wenqiang Lin, Kunming (CN); Bo Cai, Kunming (CN); Hao Wang, Kunming (CN); Xiaohua Gao, Kunming (CN); Ze Liu, Kunming (CN); Ning Ma, Kunming (CN); Guozhi Tan, Kunming (CN); Wenqi Li, Kunming (CN); Li Tang, Kunming (CN); Huitian Li, Kunming (CN)

(73) Assignee: CHINA TOBACCO YUNNAN INDUSTRIAL CO., LTD., Kunming (CN)

( * ) Notice: Subject to any disclaimer, the term of this patent is extended or adjusted under 35 U.S.C. 154(b) by 0 days.

(21) Appl. No.: 18/501,513

(22) Filed: Nov. 3, 2023

Related U.S. Application Data

(63) Continuation of application No. PCT/CN2023/075665, filed on Feb. 13, 2023.

(51) Int. Cl.
*A24B 5/02* (2006.01)
*A24B 3/04* (2006.01)

(52) U.S. Cl.
CPC . *A24B 5/02* (2013.01); *A24B 3/04* (2013.01)

(58) Field of Classification Search
None
See application file for complete search history.

(56) References Cited

U.S. PATENT DOCUMENTS

| | | | |
|---|---|---|---|
| 5,205,415 | A | 4/1993 | Surtees |
| 8,893,723 | B2 | 11/2014 | Jahnke et al. |
| 2011/0162666 | A1 | 7/2011 | Jahnke et al. |

FOREIGN PATENT DOCUMENTS

| | | | |
|---|---|---|---|
| CN | 101053868 | A | 10/2007 |
| CN | 102695429 | A | 9/2012 |
| CN | 208373581 | U | 1/2019 |
| CN | 112273704 | A | 1/2021 |

(Continued)

OTHER PUBLICATIONS

Written Opinion dated Oct. 10, 2023; International Application No. PCT/CN2023/075665; International Filing Date Feb. 13, 2023; 3 pages; China National Intellectual Property Administration (ISA/CN), Beijing, China.

*Primary Examiner* — Phu H Nguyen
(74) *Attorney, Agent, or Firm* — Andrew D. Fortney; Central California IP Group, P.C.

(57) ABSTRACT

A device for removing unwanted objects from cut tobacco in a cut tobacco production line is disclosed, which includes: a raw cut tobacco feeding and conveying unit (N1), a heavy unwanted object removal unit (N2), a cut tobacco dispersion and recovery unit (N3), a moderate unwanted object removal unit (N4), a cut tobacco humidification unit (N5) and a light unwanted object removal unit (N6). An unwanted object removal method using the cut tobacco unwanted object removal device is also disclosed. The device and method of the disclosure can effectively remove unwanted objects from cut tobacco.

6 Claims, 1 Drawing Sheet

(56) References Cited

FOREIGN PATENT DOCUMENTS

| | | | |
|---|---|---|---|
| CN | 214184106 | U | 9/2021 |
| CN | 115039905 | A | 9/2022 |
| DE | 102004020777 | A1 | 11/2005 |
| JP | 2003236474 | A | 8/2003 |

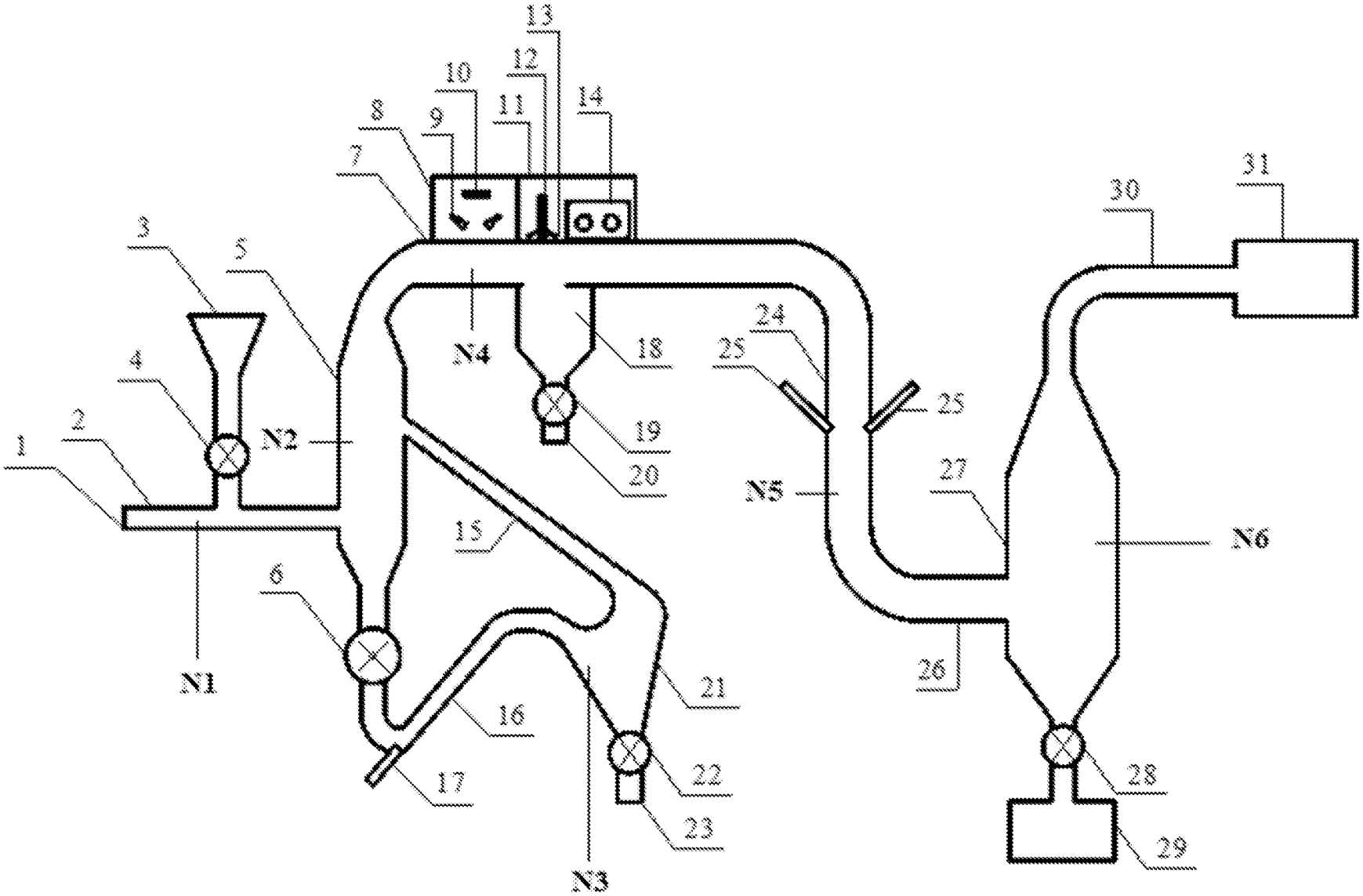
1
2
3
4
5
6
7
8
9
10
11
12
13
14
15
16
17
18
19
20
21
22
23
24
25
26
27
28
29
30
31
N1
N2
N3
N4
N5
N6

DEVICE AND METHOD FOR REMOVING UNWANTED OBJECTS FROM CUT TOBACCO IN A CUT TOBACCO PRODUCTION LINE

CROSS-REFERENCE TO RELATED APPLICATIONS

This application is a continuation of International Pat. Appl. No. PCT/CN2023/075665, filed on Feb. 13, 2023, which claims the benefit of Chinese Pat. Appl. No. 202310096208.7, filed on Feb. 3, 2023, both of which are incorporated herein by reference as if fully set forth herein.

TECHNICAL FIELD

The disclosure belongs to the technical field of tobacco processing technology, and specifically relates to a device for removing unwanted objects from cut tobacco and a method for removing unwanted objects from cut tobacco in a cut tobacco production line.

BACKGROUND

Unwanted objects in cut tobacco during the cigarette making process mainly include stems (which can be subdivided into thick stems and thin stems), agglomerated tobacco, metal, wood chips, plastics, paper, feathers, etc. Their properties are quite different from those of cut tobacco. The difference or discrepancy will cause greater harm to the subsequent rolling process and the final cigarette product, and the unwanted objects need to be removed before the cut tobacco is rolled into cigarette products. Compared with cut tobacco, unwanted objects in cut tobacco can be divided into three categories in terms of their density: heavy unwanted objects, moderate unwanted objects and light unwanted objects. The heavy unwanted objects include metal chips, wood chips, plastic particles, thick stem sticks, agglomerated cut tobacco and optionally coarse cut tobacco. Foreign objects with a density equal to or greater than normal cut tobacco are entangled with heavy foreign objects. Light foreign objects such as feathers and fine cut tobacco have a smaller density than normal cut tobacco. Moderate foreign objects, such as thin stem sticks, etc., have a density close to normal cut tobacco.

Effectively removing unwanted objects in cut tobacco during the cigarette production process has important practical significance for improving the purity and value of cut tobacco, and thus stabilizing the quality of cigarette products. At present, domestic cigarette companies primarily use flexible air separation to remove unwanted objects from cut tobacco on the production line. Although it is effective in removing heavy unwanted objects and light unwanted objects, the loss of cut tobacco is high (among the heavy unwanted objects removed). There are problems such as high cut tobacco content, poor removal effect of unwanted objects in cut tobacco (moderate unwanted objects cannot be effectively removed), and a large impact on the physical quality index of cut tobacco (large water dispersion loss in the cut tobacco). Effectively removing various unwanted objects in cut tobacco and maintaining stable physical quality indicators of processed tobacco have become difficult issues that the industry wants to solve urgently.

SUMMARY

The present disclosure is made to solve the above problems.

The object of the present disclosure is to provide a device for removing unwanted objects from cut tobacco in a cut tobacco production line and an operating method thereof, that overcome the shortcomings of the existing technology. The device of the present disclosure can effectively remove heavy unwanted objects, moderate unwanted objects and light unwanted objects from cut tobacco, and significantly improve the purity of cut tobacco. At the same time, it can humidify the cut tobacco, compensate for the loss of moisture in the cut tobacco during the unwanted object removal process, and meet the moisture content requirements for cut tobacco. In turn, it can improve the quality of cut tobacco and stabilize the quality of cigarette products.

The technical solution of the present disclosure is as follows:

A first aspect of the present disclosure concerns a device for removing unwanted objects from cut tobacco in a tobacco production line, which includes: raw cut tobacco feeding and conveying unit N1, a heavy unwanted object removal unit N2, a cut tobacco dispersion and recovery unit N3, a moderate unwanted object removal unit N4, a cut tobacco humidification unit N5, and a light unwanted object removal unit N6.

The raw cut tobacco feeding and conveying unit (N1) is upstream of the heavy unwanted object removal unit (N2). The heavy unwanted object removal unit (N2) is at an upper end of the cut tobacco dispersion and recovery unit (N3) and at a lower end of the moderate unwanted object removal unit (N4). The cut tobacco humidification unit (N5) is downstream of the moderate unwanted object removal unit (N4); and the light unwanted object removal unit (N6) is downstream of the cut tobacco humidification unit (N5).

Preferably, the raw cut tobacco feeding and conveying unit (N1) includes a horizontal pneumatic conveying pipe (2) and a raw cut tobacco feeding device (3). The raw cut tobacco feeding device (3) is on or over the pneumatic conveying pipe (2), feeds raw cut tobacco to the pneumatic conveying pipe (2), and is connected to the pneumatic conveying pipe through a feeding air lock (4). One port of the pneumatic conveying pipe (2) comprises a pneumatic conveying inlet (1) that is connected to a positive pressure fan.

The heavy unwanted object removal unit (N2) includes a vertical cylindrical heavy unwanted object air selection and separation barrel (5), and another port of the pneumatic conveying pipe (2) is connected to a wall of the heavy unwanted object air selection and separation barrel (5), at a middle and/or lower part thereof.

The cut tobacco dispersion and recovery unit (N3) includes a mechanical dispersion device (6), an inclined guide pipe (16), a positive pressure air supply pipe (17), an air separation device (21) and a recycled cut tobacco conveying pipe (15). The inclined guide pipe (16), forming an angle in the cut tobacco dispersion and recovery unit, has a lower end connected to (i) an outlet of the mechanical dispersion device (6) and (ii) the positive pressure air supply pipe (17), and an upper end connected to a feeding port of the air separation device (21). The positive pressure air supply pipe (17) is connected to a positive pressure fan. A discharge port of the air separation device (21) is connected to one port of the recycled cut tobacco conveying pipe (15). The recycled cut tobacco conveying pipe (15) is configured obliquely for example relative to the heavy unwanted object air selection and separation barrel, and has another port connected to the wall of the heavy unwanted object air selection and separation barrel (5) at the middle and/or an upper part thereof. The lower part of the air separation device (21) includes a discharge port (23) for the heavy unwanted objects, and the discharge port is configured with a heavy unwanted object discharge air lock (22). The mechanical dispersing device (6) is connected to a bottom opening of the heavy unwanted object air selection and separation barrel (5).

The moderate unwanted object removal unit (N4) includes a horizontal pneumatic conveying square tube (7), an image recognition system (8), a moderate unwanted object removal system (11), and a moderate unwanted object dropping barrel (18); wherein the image recognition system (8) includes an image acquisition camera (9) and a light source (10), and the moderate unwanted object removal system (11) includes a compressed air blow pipe (12), a solenoid valve (13) and a detection and identification signal servo controller (14). The pneumatic conveying square tube (7) is connected to an upper opening in the heavy unwanted object air selection and separation barrel (5). The image recognition system (8) is adjacent to the moderate unwanted object removal system (11) and upstream of the moderate unwanted object removal system (11), and the image recognition system (8) and the moderate unwanted object removal system (11) are on or above the transverse pneumatic conveying square tube (7). The moderate unwanted object dropping barrel (18) is below or adjacent to the transverse pneumatic conveying square tube (7) and opposite from the moderate unwanted object removal system (11). The moderate unwanted object dropping barrel (18) is configured vertically, and has an upper opening connected to the transverse pneumatic conveying square tube (7). The moderate unwanted object discharge barrel (18) also has a lower opening including a moderate foreign body discharge air lock (19) connected to a moderate unwanted object discharge port (20).

The cut tobacco humidifying unit (N5) includes a vertical pneumatic conveying round pipe (24), humidifying nozzles (25) and a horizontal guide pipe (26). The humidifying nozzles (25) are symmetrically configured on an inner wall of the pneumatic conveying round pipe (24). The pneumatic conveying round pipe (24) has a bottom opening connected to the horizontal guide pipe (26), and an upper opening connected to an outlet of the horizontal pneumatic conveying square tube (7).

The light unwanted object removal unit (N6) includes a vertical light unwanted object air selection and separation barrel (27). The light unwanted object air selection and separation barrel (27) has an upper port connected to a horizontal light unwanted objects conveying pipe (30) and a bottom port connected to a purified tobacco discharging air lock (28). The purified tobacco discharging air lock (28) is connected to a purified tobacco collection device (29) and another port connected to a light unwanted objects collection device (31). The horizontal guide pipe (26) has a discharge port connected to a side wall of the light unwanted object air selection and separation barrel (27) at a middle and/or lower part thereof.

Preferably, a positive pressure wind enters the heavy unwanted object air selection and separation barrel (5) from the pneumatic conveying inlet (1), and the positive pressure wind has a speed in a range of 2.0 m/s~8.0 m/s.

Preferably, the transverse pneumatic conveying square tube (7) has a width of 0.5 m~2.0 m and a height of 0.1 m~0.5 m. The transverse pneumatic conveying square tube (7) may comprise a transparent material, such as plexiglass or tempered glass, to facilitate image collection and identification of foreign objects for example by the image recognition system (8) under the light source (10).

Preferably, positive pressure air enters the air separation device (21) from the inclined guide pipe (16) at a speed of 2.0 m/s~6.0 m/s.

Preferably, the wind speed range of the positive pressure wind entering the lighter unwanted object air selection and separation barrel (27) from the horizontal guide pipe (26) is 0.5 m/s~1.0 m/s.

Another aspect of the current disclosure concerns a method for removing unwanted objects from cut tobacco in a cut tobacco production line, comprising removing the heavy unwanted objects, removing he moderate unwanted objects, humidifying the cut tobacco and removing the light unwanted objects using the present unwanted object removal device. Details of the steps follow:

Step 1: Removing Heavy Unwanted Objects

The raw cut tobacco enters the pneumatic conveying pipe (2) through the raw cut tobacco feeding device (3) and the feeding air lock (4), and enters the pneumatic conveying pipe (2) under the action of the positive pressure fan on the pneumatic conveying inlet (1). In the heavy unwanted object air selection and separation barrel (5), moderate and light unwanted objects and cut tobacco enter the heavy unwanted object air selection and separation barrel (5) under the combined action of the vertical upward positive pressure wind force and the gravity of the raw material itself. The top of the heavy unwanted object air selection and separation barrel (5) is connected to the horizontal pneumatic conveying square tube (7), and the heavy unwanted objects with higher density fall downwards into the mechanical dispersing device (6). After being fully loosened by the mechanical dispersing device (6), under the action of the positive pressure wind entering from the positive pressure air supply pipe (17), the heavy unwanted objects enter the air along the inclined guide pipe (16) into the air separation device (21). Under the combined action of the vertical upward positive pressure wind entering the air separation device (21) and the gravity of the material itself, the light part of the separated tobacco is transported along the recycled tobacco conveying pipe (15) back to the heavy unwanted object air selection and separation barrel (5) and is then transported to the horizontal pneumatic conveying square tube (7). The separated heavy unwanted objects are discharged through the heavy unwanted object air lock (22) and the heavy unwanted object discharge port (23).

Step 2: Removing Moderate Unwanted Objects

The moderate and light unwanted objects and cut tobacco that are transported to the horizontal pneumatic conveying square tube (7) in step 1 are recognized by the image recognition system (8), and the moderate unwanted objects in the cut tobacco are identified and removed by the moderate unwanted object removal system (11). The cut tobacco with moderate unwanted objects removed continues to move downstream along the transverse pneumatic conveying square tube (7) and enters the vertical pneumatic conveying round tube (24), while the removed moderate unwanted objects fall into the moderate unwanted object discharge barrel (18) and are discharged through the moderate unwanted object discharge air lock (19) and the moderate unwanted object discharge port (20).

Step 3: Humidifying the Cut Tobacco

The cut tobacco with moderate unwanted objects removed that enters the vertical pneumatic conveying circular tube (24) in step 2 is humidified by water vapor sprayed from the humidifying nozzles (25) during its movement downwardly through the vertical pneumatic conveying circular tube (24). The final cut tobacco is transported to the light unwanted object air selection and separation barrel (27) through the horizontal guide pipe (26).

Step 4: Removing Light Unwanted Objects

The cut tobacco humidified in step 3 is transported to the light unwanted object air selection and separation barrel (27). After entering the light unwanted object air selection and separation barrel (27), under the combined action of a relatively weak vertical upward positive pressure wind and the material's own gravity, the humidified cut tobacco falls downward along the light unwanted object air selection and separation barrel (27), and enters the purified cut tobacco collecting device (29) through the purified cut tobacco discharging air lock (28). The discharged purified cut tobacco is qualified as purified tobacco. The light unwanted objects float upward along the light unwanted object air selection and separation barrel (27), and enter the light unwanted object collection device (31) through the light unwanted object conveying pipe (30).

Compared with the prior art, the present disclosure has the following beneficial effects:

1. The unwanted object removal device of the present disclosure includes various stages, such as a heavy unwanted object removal unit, a moderate unwanted object removal unit and a light unwanted object removal unit. The heavy and light unwanted objects are removed by air selection, and the moderate unwanted objects are removed by image processing, optionally combined with compressed air on the unwanted objects identified by the image processing. The identification and precise blowing method can remove unwanted objects that are heavy, moderate and light in density relative to the cut tobacco, and can effectively remove all unwanted objects in the cut tobacco, thereby significantly improving the purity of the cut tobacco and improving the quality and value of the cut tobacco.
2. The unwanted object removal device of the present disclosure accurately controls the wind speed or air pressure in each component. Research supporting the present disclosure found that when the positive pressure wind speed is greater than 2.5 m/s, the buoyancy force is greater than the force of gravity, and the cut tobacco is transported with the positive pressure wind; when the positive pressure wind speed is less than 2.5 m/s, the force of gravity is greater than the buoyancy force, and the cut tobacco is not transported with the positive pressure wind transportation, but rather, settles downward due to gravity. When the positive pressure wind speed is greater than 8.0 m/s, the heavy unwanted objects in the cut tobacco cannot be effectively removed, and when the positive pressure wind speed range is less than 1.0 m/s, the light unwanted objects can be effectively removed without affecting normal cut tobacco settling. Therefore, the present disclosure determines the range of air separation wind speeds, which is a key process parameter for air separation of and removal of impurities and other unwanted objects from tobacco material.
3. The unwanted object removal device of the present disclosure includes a loose tobacco recovery unit, and uses mechanical dispersion and flexible air separation to separate the tobacco from the heavy unwanted objects (agglomerated tobacco and part[s] of the tobacco entangled with the heavy unwanted objects). Such processing can partially or fully recover the cut tobacco from the heavy unwanted objects, which can effectively reduce the loss of cut tobacco during the removal of heavy unwanted objects and effectively improve economic benefits.
4. The device for removing unwanted objects from cut tobacco of the present disclosure also includes a cut tobacco humidifying unit, which adopts a symmetrical and oblique downward humidification mode with humidifying nozzles, which can compensate for the loss of moisture content from cut tobacco during the unwanted object removal process and meet the requirements of a subsequent rolling process for moisture content in the cut tobacco, meet the requirements of the rate index, improve the stability of the moisture content of cut tobacco, and thereby stabilize the quality of cigarette products.
5. The unwanted object removal device of the present disclosure adopts a positive pressure air conveying method for feeding cur tobacco through the various stages of the device, and the stages such as the heavy unwanted object removal unit, the moderate unwanted object removal unit and the cut tobacco humidification unit adopt pneumatic conveying methods. Compared with the current cut tobacco production line, the flexible air separation and feeding in the present cut tobacco production line may also use a vibrating conveyor belt thinning method, which can effectively improve the looseness of the cut tobacco and increase the flow rate of cut tobacco processing, which is more conducive to large-scale industrial production.
6. The unwanted object removal device of the present disclosure has a compact and simple structure, strong operability and applicability, and has good application prospects and promotion and application value.

BRIEF DESCRIPTION OF THE DRAWINGS

In order to explain the embodiments of the present disclosure or the technical solutions in the prior art more clearly, the drawing referred to in the description of the embodiments will be briefly introduced below. Obviously, the drawing in the following description refer only to some embodiments of the present disclosure. For those of ordinary skill in the art, other drawings can be obtained based on these drawings without exerting creative efforts.

FIG. 1 is a schematic diagram of the overall structure of the unwanted object removal device for a tobacco production line of the present disclosure.

Reference symbols: N1—raw cut tobacco feeding and conveying unit; N2—heavy unwanted object removal unit; N3—cut tobacco dispersion and recovery unit; N4—moderate unwanted object removal unit; N5—cut tobacco humidification unit; N6—light unwanted object removal unit; 1—pneumatic conveying entrance; 2—pneumatic conveying pipe; 3—raw cut tobacco feeding device; 4—feeding air lock; 5—heavy unwanted object air selection and separation barrel; 6—mechanical dispersing device; 7—pneumatic conveying square tube; 8—image recognition system; 9—image acquisition camera; 10—light source; 11—moderate unwanted object removal system; 12—compressed air blow pipe; 13—solenoid valve; 14—detection and identification signal servo controller; 15—recovered cut tobacco conveying pipe; 16—inclined diversion pipe; 17—positive pressure air supply pipe; 18—moderate unwanted object dropping barrel; 19—moderate unwanted object discharge air lock; 20—moderate unwanted object discharge port; 21—cut tobacco air separation device; 22—air lock for discharging heavy unwanted objects; 23—discharge port for heavy unwanted objects; 24—pneumatic conveying round pipe; 25—humidifying nozzle; 26—horizontal diversion tube; 27—air selection and separation barrel for light unwanted objects; 28—purified cut tobacco discharging air lock; 29—purified cut tobacco collection device; 30—pneumatic conveying pipe for light unwanted objects; 31—light unwanted object collection device.

DETAILED DESCRIPTION

The present disclosure will be further described below in conjunction with the accompanying drawings and examples. However, the accompanying drawings and examples do not limit the technical solution of the present disclosure. Any transformation or improvement based on the teachings of the present disclosure falls within the protection scope of the present disclosure.

Example

As shown in FIG. 1, a device for removing unwanted objects from cut tobacco in a tobacco production line comprises: a raw cut tobacco feeding and conveying unit N1, a heavy unwanted object removal unit N2, a cut tobacco dispersion and recovery unit N3, a moderate unwanted object removal unit N4, a cut tobacco humidification unit N5 and a light unwanted object removal unit N6. The raw cut tobacco feeding and conveying unit (N1) is upstream of the heavy unwanted object removal unit (N2), The heavy unwanted object removal unit (N2) is at an upper end of the cut tobacco dispersion and recovery unit (N3) and at a lower end of the moderate unwanted object removal unit (N4). The cut tobacco humidification unit (N5) is downstream of the moderate unwanted object removal unit (N4), and the light unwanted object removal unit (N6) is downstream of the cut tobacco humidification unit (N5).

The raw cut tobacco feeding and conveying unit (N1) includes a horizontal pneumatic conveying pipe (2) and a raw cut tobacco feeding device (3). The raw cut tobacco feeding device (3) is over the pneumatic conveying pipe (2) and connected to the pneumatic conveying pipe (2) by a feeding air lock (4). One port of the pneumatic conveying pipe (2) includes a pneumatic conveying inlet (1) and is connected to a positive pressure fan.

The heavy unwanted object removal unit (N2) includes a vertical cylindrical heavy unwanted object air selection and separation barrel (5). The pneumatic conveying pipe (2) has another port that is connected to a middle and/or lower part of a wall of the heavy unwanted object air selection and separation barrel (5).

The cut tobacco dispersion and recovery unit (N3) includes a mechanical dispersion device (6), an inclined guide pipe (16), a positive pressure air supply pipe (17), an air separation device (21) and a recycled cut tobacco conveying pipe (15). The inclined guide pipe (16) is at a non-horizontal and non-vertical angle in the cut tobacco dispersion and recovery unit, and has (i) a lower end connected to an outlet of the mechanical dispersion device (6) and an inlet of the positive pressure air supply pipe (17) and (ii) an upper end connected to a feeding port of the air separation device (21). One end of the positive pressure air supply pipe (17) is connected to a positive pressure fan. A discharge port of the air separation device (21) is connected to one port of the recycled cut tobacco conveying pipe (15). The recycled cut tobacco conveying pipe (15) is configured obliquely, and has another port connected to an upper or middle part of the wall of the heavy unwanted object air selection and separation barrel (5). A lower part of the air separation device (21) includes a discharge port (23) for heavy unwanted objects, and the discharge port (23) includes a heavy unwanted object discharge air lock (22). The mechanical dispersing device (6) is connected to an opening in the bottom of the heavy unwanted object air selection and separation barrel (5).

The moderate unwanted object removal unit (N4) includes a horizontal pneumatic conveying square tube (7), an image recognition system (8), a moderate unwanted object removal system (11), and a moderate unwanted object dropping barrel (18). The image recognition system (8) includes an image acquisition camera (9) and a light source (10). The moderate unwanted object removal system (11) includes a compressed air blow pipe (12), a solenoid valve (13) and a detection and identification signal servo controller (14). The pneumatic conveying square tube (7) is connected to an upper opening of the heavy unwanted object air selection and separation barrel (5). The image recognition system (8) is adjacent to and upstream from the moderate unwanted object removal system (11), and the image recognition system (8) and the moderate unwanted object removal system (11) are above and/or connected to the transverse pneumatic conveying square tube (7). The moderate unwanted object dropping barrel (18) is below the transverse pneumatic conveying square tube (7) and/or opposite from the moderate unwanted object removal system (11). The moderate unwanted object dropping barrel (18) is configured vertically, and has an upper opening connected with the wall of the transverse pneumatic conveying square tube (7). A lower opening of the moderate unwanted object discharge barrel (18) includes a moderate unwanted object discharge port (20) and a moderate foreign body discharge air lock (19) configured to control discharges of moderate unwanted objects from the moderate unwanted object discharge barrel (18).

The cut tobacco humidifying unit (N5) includes a vertical pneumatic conveying round pipe (24), humidifying nozzles (25) and a horizontal guide pipe (26). The humidifying nozzles (25) are symmetrically configured on an inner wall of the pneumatic conveying round pipe (24). The pneumatic conveying round pipe (24) has a bottom opening connected to the horizontal guide pipe (26) and an upper opening connected to an outlet of the horizontal pneumatic conveying square tube (7).

The light unwanted object removal unit (N6) includes a vertical light unwanted object air selection and separation barrel (27). The light unwanted object air selection and separation barrel (27) has an upper port connected to a horizontal light unwanted object conveying pipe (30) and a bottom port connected to a purified tobacco discharging air lock (28) and a purified tobacco collection device (29). The horizontal light unwanted object conveying pipe (30) has a port connected to a light unwanted object collection device (31). The horizontal guide pipe (26) has a discharge port connected to a middle and/or lower part of a sidewall of the light unwanted object air selection and separation barrel (27).

The positive pressure air/wind entering the heavy unwanted object air selection and separation barrel (5) from the pneumatic conveying inlet (1) has a speed in the range of 2.0 m/s~8.0 m/s.

The transverse pneumatic conveying square tube (7) has a width of 0.5 m~2.0 m, and a height of 0.1 m~0.5 m. The transverse pneumatic conveying square tube (7) comprises a transparent material, such as plexiglass or tempered glass, to facilitate image collection and identification of foreign objects by the image acquisition camera (9) under the light source (10).

The positive pressure air/wind entering the air separation device (21) from the inclined guide pipe (16) has a speed of 2.0 m/s~6.0 m/s. In one example, the wind speed is 2.8 m/s.

The positive pressure air/wind entering the light unwanted object air selection and separation barrel (27) from the horizontal guide pipe (26) has a speed in the range of 0.5 m/s~1.0 m/s. In one example, the wind speed is optimized at 0.5 m/s.

Another aspect of current disclosure concerns a method for removing unwanted objects from cut tobacco in a cut tobacco production line, comprising: removing heavy unwanted objects, removing moderate unwanted objects, humidifying cut tobacco and removing light unwanted objects. Details of these steps follow.

Step 1: Removing Heavy Unwanted Objects

The raw cut tobacco enters the pneumatic conveying pipe (2) through the raw cut tobacco feeding device (3) and the feeding air lock (4), and enters the pneumatic conveying pipe (2) under the action of the positive pressure fan on the pneumatic conveying inlet (1). In the heavy unwanted object air selection and separation barrel (5), moderate and light unwanted objects and cut tobacco enter the heavy unwanted object air selection and separation barrel (5) and, under the combined action of the vertical upward positive pressure wind force and gravity, are transported to the top of the heavy unwanted object air selection and separation barrel (5) and into the horizontal pneumatic conveying square tube (7), while the heavy unwanted objects with greater density fall downwards into the mechanical dispersing device (6). After being fully loosened by the mechanical dispersing device (6), under the action of the positive pressure wind entering from the positive pressure air supply pipe (17), the heavy unwanted objects and any agglomerated tobacco and tobacco entangled therewith enter the inclined guide pipe (16) and are transported by the positive pressure wind along the inclined guide pipe (16) into the air separation device (21). Under the combined action of the vertical upward positive pressure wind entering the air separation device (21) and the gravity of the material itself, the relatively light part of the agglomerated and/or entangled tobacco loosened by the mechanical dispersing device (6) is transported along the recovered tobacco conveying pipe (15) back to the heavy unwanted object air selection and separation barrel (5) and then transported to the horizontal pneumatic conveying square tube (7). The separated heavy unwanted objects are discharged through the heavy unwanted object air lock (22) and heavy unwanted object discharge port (23).

Step 2: Removing Moderate Unwanted Objects

The moderate and light unwanted objects and cut tobacco in step 1 that are transported to the horizontal pneumatic conveying square tube (7) are recognized by the image recognition system (8), and the moderate unwanted objects in the cut tobacco are identified and removed by the moderate unwanted object removal system (11). For example, the image recognition system (8) recognizes moderate unwanted objects in the cut tobacco in the horizontal pneumatic conveying square tube (7), and sends a detection signal to the detection and identification signal servo controller (14), which in turn controls the solenoid valve (13). When open, the solenoid valve (13) allows relatively high-pressure air to exit the air blow pipe (12), thereby forcing detected moderate unwanted objects towards the moderate unwanted object discharge barrel (18). Optionally, the detection and identification signal servo controller (14) can control one or more motors that can change a direction in which the air blow pipe (12) points so that the air blow pipe (12) is aimed towards a moderate unwanted object identified and/or detected by the moderate unwanted object removal system (11). The cut tobacco with moderate unwanted objects removed continues to move downstream along the transverse pneumatic conveying square tube (7) and enters the vertical pneumatic conveying round tube (24), while the removed moderate unwanted objects are moved into the moderate unwanted object discharge barrel (18) and are discharged through the moderate unwanted object discharge air lock (19) and the moderate unwanted object discharge port (20).

Step 3: Humidifying the Cut Tobacco

The cut tobacco with moderate unwanted objects removed that enters the vertical pneumatic conveying circular tube (24) in the second step is humidified by water vapor sprayed from the humidifying nozzles (25) during its downward movement through the vertical pneumatic conveying circular tube (24). The humidified cut tobacco is transported to the light unwanted object air selection and separation barrel (27) through the horizontal guide pipe (26).

Step 4: Removing Light Unwanted Objects

The humidified cut tobacco from step 3 is transported to the light unwanted object air selection and separation barrel (27). After entering the light unwanted object air selection and separation barrel (27), under the combined action of a relatively weak vertical upward positive air/wind pressure and gravity, the humidified cut tobacco falls downward along the light unwanted object air selection and separation tube (27), and enters the purified cut tobacco collecting device (29) through the purified cut tobacco discharging air lock (28), and the light unwanted objects float upward along the light unwanted object air selection and separation tube (27) and enter the light unwanted object collection device (31) through the light unwanted object conveying pipe (30). The humidified cut tobacco entering the purified cut tobacco collecting device (29) is qualified purified tobacco.

In one experimental example, 1000 kg of dried cut tobacco from a certain cigarette brand's tobacco shredding production line, having a moisture content of 12.98%, includes unwanted objects therein, mainly stems and agglomerated cut tobacco. The proportion of unwanted objects in the cut tobacco was detected to be 7.65%. The cut tobacco is divided into two equal parts, each part being 500 kg. The cut tobacco unwanted object removal device of the present disclosure is used to remove unwanted objects from one part of the cut tobacco, and an existing FS417A type shredded flexible air separator is used to remove unwanted objects from the other part of the cut tobacco, respectively. The purity and moisture content of treated cut tobacco are tested. The results of comparative analysis of the effects of the two machines and methods on removing unwanted objects from the cut tobacco are shown in Table 1. The purity of the treated cut tobacco is calculated according to the following: 1−([the mass of the unwanted objects in the cut tobacco]/[the mass of cut tobacco]×100%).

TABLE 1

Comparison of the effects of two methods on removing unwanted objects from cut tobacco

| | The quantity of unwanted objects removed (kg) | Tobacco purity | Moisture content of cut tobacco after treatment |
|---|---|---|---|
| FS417A Flexible air separator | 20.37 | 96.43% | 12.34% |
| Device in the current disclosure | 35.48 | 99.45% | 13.01% |

As it can be seen from Table 1, when compared with the FS417A type flexible air separator for cut tobacco, when the same cut tobacco is processed, the unwanted object removal device of the present disclosure can remove more completely unwanted objects from the cut tobacco, and the purity of the cut tobacco is higher. The moisture content is slightly, but not significantly, different from that before treatment. This shows that the device of the present disclosure can effectively remove unwanted objects in cut tobacco, significantly improve the purity of cut tobacco, and at the same time keep the moisture content of cut tobacco basically unaffected, thereby increasing the value of the cut tobacco and stabilizing the quality of cigarette products, which is beneficial to improving the core competitiveness of cigarette companies and to promoting the high-quality development of cigarette brands.

The above description is only used to introduce specific implementations of the present disclosure in detail, but the technical solution(s) in the present disclosure are not limited to the specific system and method above. Without departing from the basic principles of the present technology, equivalent modifications and changes made by those skilled in the art to the technology proposed by the present disclosure shall be covered by the claims of the present disclosure.

What is claimed is:

1. A device for removing unwanted objects from cut tobacco in a cut tobacco production line, comprising: a raw cut tobacco feeding and conveying unit, a heavy unwanted object removal unit, a cut tobacco dispersion and recovery unit, a moderate unwanted object removal unit, a cut tobacco humidification unit and a light unwanted object removal unit; wherein:

the raw cut tobacco feeding and conveying unit is upstream of the heavy unwanted object removal unit; the heavy unwanted object removal unit is at an upper end of the cut tobacco dispersion and recovery unit and at a lower end of the moderate unwanted object removal unit; the cut tobacco humidification unit is downstream of the moderate unwanted object removal unit; and the light unwanted object removal unit is downstream of the cut tobacco humidification unit;

the raw cut tobacco feeding and conveying unit includes a horizontal pneumatic conveying pipe and a raw cut tobacco feeding device, the raw cut tobacco feeding device is on or over the pneumatic conveying pipe and connected to the pneumatic conveying pipe through a feeding air lock, and the pneumatic conveying pipe has a port comprising a pneumatic conveying inlet that is connected to a positive pressure fan;

the heavy unwanted object removal unit includes a vertical cylindrical heavy unwanted object air selection and separation barrel, wherein the pneumatic conveying pipe has another port connected to a wall of the heavy unwanted object air selection and separation barrel at a middle and/or lower part thereof;

the cut tobacco dispersion and recovery unit includes a mechanical dispersion device, an inclined guide pipe, a positive pressure air supply pipe, an air separation device and a recovered cut tobacco conveying pipe; the inclined guide pipe forms an angle in the cut tobacco dispersion and recovery unit, and has (i) a lower end connected to an outlet of the mechanical dispersion device and the positive pressure air supply pipe and (ii) an upper end connected to a feeding port of the air separation device; the positive pressure air supply pipe is connected to a positive pressure fan; a discharge port of the air separation device is connected to one port of the cut tobacco conveying pipe; the recovered cut tobacco conveying pipe is configured obliquely, and has another port connected to the wall of the heavy unwanted object air selection and separation barrel at the middle and/or an upper part thereof; the air separation device includes a lower part having a discharge port configured with a heavy unwanted object discharge air lock; and the mechanical dispersion device is connected to a bottom opening of the heavy unwanted object air selection and separation barrel;

the moderate unwanted object removal unit includes a horizontal pneumatic conveying square tube, an image recognition system, a moderate unwanted object removal system, and a moderate unwanted object dropping barrel; wherein the image recognition system includes an image acquisition camera and a light source; the moderate unwanted object removal system includes a compressed air blow pipe, a solenoid valve and a detection and identification signal servo controller; the pneumatic conveying square tube is connected to an upper opening in the heavy unwanted object air selection and separation barrel; the image recognition system is adjacent to the moderate unwanted object removal system and upstream of the moderate unwanted object removal system; the image recognition system and the moderate unwanted object removal system are on or above the transverse pneumatic conveying square tube; the moderate unwanted object dropping barrel is below or adjacent to the transverse pneumatic conveying square tube and opposite from the moderate unwanted object removal system; the moderate unwanted object dropping barrel is configured vertically, and has an upper opening connected to the transverse pneumatic conveying square tube and a lower opening comprising a moderate foreign body discharge air lock connected to a moderate unwanted object discharge port;

the cut tobacco humidifying unit includes a vertical pneumatic conveying round pipe, humidifying nozzles and a horizontal guide pipe; the humidifying nozzles are symmetrically configured on an inner wall of the pneumatic conveying round pipe; the pneumatic conveying round pipe has a bottom opening connected to the horizontal guide pipe, and an upper opening connected to an outlet of the horizontal pneumatic conveying square tube; and the light unwanted object removal unit includes a vertical light unwanted object air selection and separation barrel having an upper port connected to a horizontal light unwanted object conveying pipe and a bottom port connected to a purified tobacco discharging air lock; the purified tobacco discharging air lock is connected to a purified tobacco collection device, and the light unwanted object conveying pipe is connected to a light unwanted object collection device, wherein the horizontal guide pipe has a discharge port connected to a side wall of the light unwanted object air selection and separation barrel at a middle and/or lower part thereof.

2. The device for removing unwanted objects from cut tobacco in the cut tobacco production line according to claim 1, wherein a positive pressure wind enters the heavy unwanted object air selection and separation barrel from the pneumatic conveying inlet at a speed of 2.0 m/s~8.0 m/s.

3. The device for removing unwanted objects from cut tobacco in the cut tobacco production line according to claim 1, wherein the transverse pneumatic conveying square tube has a width of 0.5 m~2.0 m and a height of 0.1 m~0.5 m, and comprises a transparent material.

4. The device for removing unwanted objects from cut tobacco in the cut tobacco production line according to claim 1, wherein positive pressure air enters the air separation device from the inclined guide pipe at a speed of 2.0 m/s~6.0 m/s.

5. The device for removing unwanted objects from cut tobacco in the cut tobacco production line according to claim 1, wherein a positive pressure wind enters the light unwanted object air selection and separation barrel from the horizontal guide pipe at a speed of 0.5 m/s~1.0 m/s.

6. A method for removing unwanted objects from cut tobacco in the cut tobacco production line, comprising removing the heavy unwanted objects, removing the moderate unwanted objects, humidifying the cut tobacco, and removing the light unwanted objects using the unwanted object removal device in claim 1, wherein:

removing the heavy unwanted objects comprises feeding raw cut tobacco to the pneumatic conveying pipe through the raw cut tobacco feeding device and the feeding air lock, the raw cut tobacco entering the pneumatic conveying pipe under action of the positive pressure fan on the pneumatic conveying inlet; separating moderate and light unwanted objects and cut tobacco from the heavy unwanted objects in the heavy unwanted object air selection and separation barrel under combined action of vertical upward positive pressure wind and gravity; transporting the moderate and light unwanted objects and the cut tobacco to the horizontal pneumatic conveying square tube, while the heavy unwanted objects fall into the mechanical dispersing device; loosening the heavy unwanted objects with the mechanical dispersing device; transporting the heavy unwanted objects using a positive pressure wind from the positive pressure air supply pipe along the inclined guide pipe into the air separation device; transporting a light part of separated tobacco in the heavy unwanted objects along the recovered tobacco conveying pipe back to the heavy unwanted object air selection and separation barrel using a vertical upward positive pressure wind in the air separation device, and discharging separated heavy unwanted objects through the heavy unwanted object air lock and heavy unwanted object discharge port;

removing moderate unwanted objects comprises recognizing the moderate and light unwanted objects and cut tobacco transported to the horizontal pneumatic conveying square tube with the image recognition system; identifying and removing the moderate unwanted objects in the cut tobacco using the moderate unwanted object removal system; moving the cut tobacco with moderate unwanted objects removed downstream along the transverse pneumatic conveying square tube to the vertical pneumatic conveying round tube, while the moderate unwanted objects move into the moderate unwanted object discharge barrel; and discharging the moderate unwanted objects through the moderate unwanted object discharge air lock and the moderate unwanted object discharge port;

humidifying the cut tobacco comprises spraying the cut tobacco in the vertical pneumatic conveying circular tube with the water vapor from the humidifying nozzles, and transporting the humidified cut tobacco to the light unwanted object air selection and separation barrel through the horizontal guide pipe; and removing the light unwanted objects comprises floating the light unwanted objects upward along the light unwanted object air selection and separation barrel and into the light unwanted object collection device through the light unwanted object conveying pipe using a weak vertical upward positive pressure wind, and allowing the humidified cut tobacco to fall downward along the light unwanted object air selection and separation barrel and enter the purified cut tobacco collecting device through the purified cut tobacco discharging air lock.

* * * * *